US005335855A

United States Patent [19]

Borod

[11] Patent Number: 5,335,855

[45] Date of Patent: Aug. 9, 1994

[54] HYGIENIC SPRAY BOTTLE

[76] Inventor: Murray Borod, 3723 Parker Hill Rd., Santa Rosa, Calif. 95404

[21] Appl. No.: 111,117

[22] Filed: Aug. 24, 1993

[51] Int. Cl.[5] ..... B05B 1/16; B05B 9/043

[52] U.S. Cl. ..... 239/152; 239/354; 239/361; 239/373; 239/391; 239/562; 239/566

[58] Field of Search ..... 239/16, 279, 282, 283, 239/354, 361, 373, 391, 562, 566, 152, 154, 587.1, 588; 222/401, 575; 604/140, 146, 151; 206/581

[56] References Cited

U.S. PATENT DOCUMENTS

| | | | |
|---|---|---|---|
| 40,192 | 10/1863 | Singer | 239/373 X |
| 263,735 | 9/1882 | Snyder | 239/373 X |
| 528,946 | 11/1894 | Knittel | 239/373 X |
| 1,246,213 | 11/1917 | Zawels et al. | 239/373 X |
| 1,609,125 | 11/1926 | Pitt | 604/146 X |
| 2,091,735 | 8/1937 | Jepson | 222/401 |
| 2,968,441 | 1/1961 | Holcomb | 239/588 X |
| 3,402,741 | 9/1968 | Yurdin | 239/588 X |
| 3,602,921 | 9/1971 | Umann . | |
| 3,724,760 | 4/1973 | Smith | 239/564 X |
| 3,808,608 | 5/1974 | Caplan . | |
| 3,914,804 | 10/1975 | Schrader et al. . | |
| 4,259,754 | 4/1981 | Bader et al. . | |
| 4,280,643 | 7/1981 | Cordova et al. | 206/581 X |
| 4,952,210 | 8/1990 | Alchas . | |
| 4,974,730 | 12/1990 | Deruysscher | 206/581 |
| 5,090,063 | 2/1992 | Edwards et al. | 206/581 X |
| 5,097,540 | 3/1992 | Lovitt . | |
| 5,156,593 | 10/1992 | Green . | |

FOREIGN PATENT DOCUMENTS

| | | |
|---|---|---|
| 90653 | 7/1895 | Fed. Rep. of Germany . |
| 311726 | 4/1919 | Fed. Rep. of Germany . |
| 1535794 | 12/1978 | United Kingdom . |

*Primary Examiner*—Andres Kashnikow
*Assistant Examiner*—William Grant
*Attorney, Agent, or Firm*—Richard C. Litman

[57] ABSTRACT

A hygienic kit including a spray bottle for dispensing a medicament, balm, or similar liquid, including refillable containers of such liquids, and a supply of absorbent material, such as cotton swabs. The spray bottle has a screw-on cap including a hand pump for building up air pressure bearing on the liquid; a rigid, preformed discharge tube having a nozzle; a manual valve for dispensing the pressurized liquid at will; and a pickup tube extending to the bottom of the bottle. The discharge tube is configured to cooperate with a toilet bowl wall, so that the spray bottle is usable as a portable bidet. The discharge tube has a sliding sleeve selectively covering and uncovering liquid spray holes, so that the spray pattern or location is varied. In an alternative embodiment, the discharge tube includes a flexible section, enabling the nozzle to be advantageously oriented by the user, as for douching. It is compact, lightweight, and practical for travel, being usable in the absence of an external plumbing system or electrical power, and thus would be highly practical for camping in wilderness areas, or in other situations wherein plumbing or electrical amenities are lacking.

8 Claims, 5 Drawing Sheets

54
56
58
60
62
64
66
70

FIG. 6
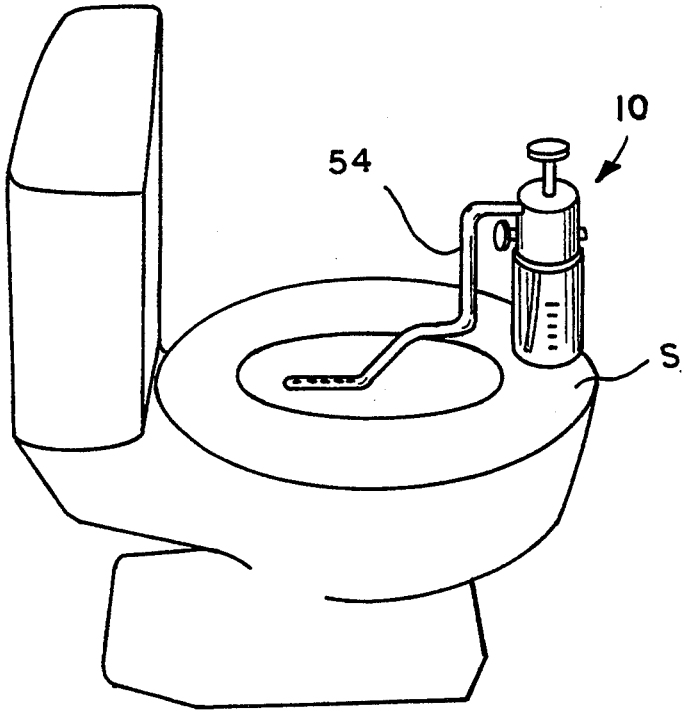
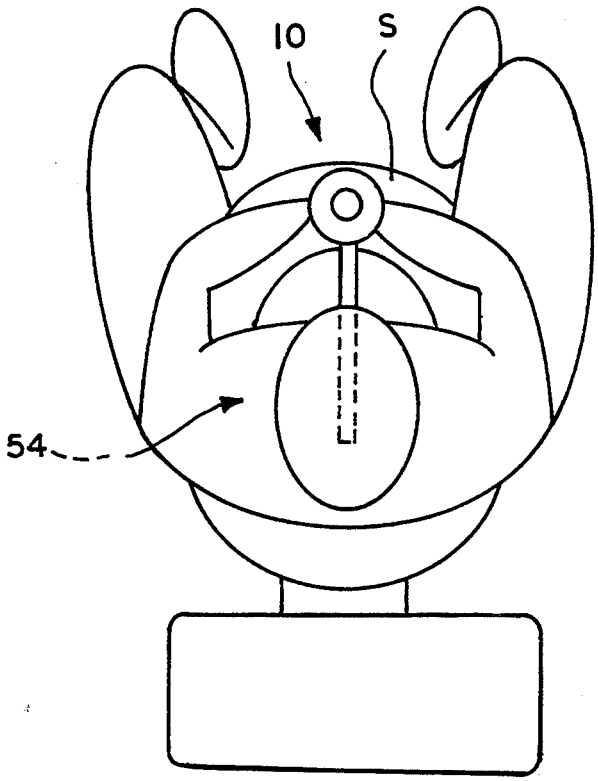
FIG. 7

HYGIENIC SPRAY BOTTLE

BACKGROUND OF THE INVENTION

1. Field of the Invention

The present invention relates to a spray bottle, and more particularly to a spray bottle which is pressurized by hand and which dispenses a spray upon demand.

2. Description of the Prior Art

The need for a portable hygienic device for rectal or vaginal douching, or other cleaning by spray, arises from time to time. Most known bideta are self-contained units, large and heavy, and not portable. In order to meet the need, and to take advantage of preexisting toilets or water closets, bidet accessories have been developed for attachment to preexisting toilets or plumbing systems, and possibly require connection to electrical power.

Devices, both of the bidet type and for other purposes, appear in the prior art for holding liquid and dispensing the same under pressure. Examples include U.S. Pat. No. 3,602,921, issued to Harry M. Umann et al. on Sep. 7, 1971, which discloses a portable bidet having a reservoir for douching liquid and a hand pump for dispensing liquid. The pump expels that amount of liquid contained therein. Another example is seen in U.S. Pat. No. 4,952,210, issued to Paul G. Alchas on Aug. 28, 1990, disclosing apparatus for dispensing parenteral fluid, including a manually pressurized reservoir.

Some prior art liquid dispensers provide increased convenience, albeit at the cost of dependence upon plumbing and electrical systems. Included in this group are U.S. Pat. Nos. 3,808,608, issued to David Caplan on May 7, 1974, disclosing a portable bidet which has a powered water pump, and which sits on an adjacent environmental surface, only the liquid discharge nozzle attaching to the toilet, and 3,914,804, issued to Clarence O. Schrader et al. on Oct. 28, 1975, disclosing a bidet accessory mountable on a toilet bowl, which invention features electrically powered water pressurization and heating. Different functions, such as for douching or for an enema, can be accommodated by changing water discharge tubes which support a nozzle.

Still another example is seen in U.S. Pat. No. 4,259,754, issued to Jacob Bader et al. on Apr. 7, 1981, disclosing a bidet accessory having a liquid reservoir upon which a spring biased piston bears, thus pressurizing the liquid. The reservoir is filled by attachment to a plumbing system which has sufficient pressure to fill the reservoir while pushing the piston back against the force of the spring. A manually operated valve releases liquid for spraying.

In U.K. Pat. No. 1,535,794, dated December, 1978, a sanitary washing device is presented which must be connected to hot and cold household plumbing.

To maximize the practicality of the stand-alone, self-contained type of dispenser, it is preferred not to rely on connection to a plumbing supply or to electrical power, even if the latter is in portable form, as provided by storage cells. A dispensing apparatus having these advantages is presented in U.S. Pat. No. 5,097,540, issued to Harold B. Lovitt on Mar. 24, 1992. This invention, a self-contained, hand held bidet, is pressurized in one embodiment by a hand pump.

U.S. Pat. No. 5,156,593, issued to Milton L. Green on Oct. 20, 1992, discloses an esophagus probe. The apparatus presented therein includes a liquid holding receptacle, a hand pump, and a wand having a discharge nozzle connected to the pump.

German Pat. Document No. 90,653, dated Jul. 5, 1895, discloses a spray apparatus for disinfectant dispensing, the apparatus including a liquid container which is partially filled with liquid, a remaining portion of the container being pressurized by compressed air delivered by a hand pump. A dispensing conduit includes a manual valve releasing pressurized liquid.

Another liquid dispenser is shown in German Pat. Document No. 311,726, dated April, 1919. Pump action bears directly on the liquid. This invention has ability to retrieve dispensed liquid, which is not of relevance to the present invention.

None of the above inventions and patents, taken either singly or in combination, is seen to describe the instant invention as claimed.

SUMMARY OF THE INVENTION

The need for the utility provided by a bidet is well documented in the references discussed hereinabove. The present invention seeks to provide this utility in a form entirely independent of external plumbing and energy sources. This independence renders the invention quite practical to those far from such amenities, such as would be encountered in camping in wilderness areas. It is also desired to provide as uncomplicated an apparatus as possible, to minimize costs and ensure long term reliability, and, for the benefit of travelers, to make the apparatus small and light weight.

To these ends, the novel portable hygienic device comprises a liquid container and a cap which is screwed thereonto. The container is partially occupied by liquid for dispensing, and air occupying a remaining portion of the container is compressed. The cap includes an air pump for building up pressure, and a dispensing valve. Once pressure is built up, the hygienic device can be carried about, and the liquid dispensed at will.

A dispensing conduit attaches to the cap, and terminates in a nozzle having a series of holes which determine a desired spray pattern. A sliding sleeve selectively covers and uncovers certain spray holes, so that the spray issues from holes nearer to or farther from the container, as desired. In alternative embodiments, the dispensing conduit is rigid or partially flexible.

The spray apparatus of the novel hygienic device is preferably made part of a kit. The kit also includes small, refillable bottles of therapeutic liquids, which may include, selectively, general tonics, such as those containing aloe; specialized medicaments, as for treatment of hemorrhoids or vaginal douches; and a general cleanser, such as liquid soap suitable for skin contact. The kit also preferably contains a supply of absorbent materials for drying, such as cotton swabs.

Accordingly, it is a principal object of the invention to provide a hygienic spray apparatus which is pressurized by hand, and stores this pressure.

It is another object of the invention to provide a hygienic spray apparatus which releases pressurized liquid on demand.

It is a further object of the invention to provide a hygienic spray apparatus which has a transparent container having indicia thereon, whereby the amount of liquid being stored is discerned by observation.

Still another object of the invention is to provide a hygienic spray apparatus having a cap which is readily and securely installed and removed by hand.

Yet a further object of the invention is to provide a hygienic spray apparatus which is configured in a manner making it convenient to handle while spraying the rectal or vaginal area.

An additional object of the invention is to provide a hygienic spray apparatus which is configured to cooperate with a typical toilet bowl.

Yet another object of the invention is to provide a hygienic spray apparatus having a dispensing conduit which selectively varies the spray pattern.

Still a further object of the invention is to provide a hygienic spray kit including a sprayer; separate, refillable containers containing any of several therapeutic liquids; and drying accessories.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 6 is an environmental, diagrammatic, perspective detail view of the novel spray apparatus.

FIG. 7 is an environmental, top plan, diagrammatic view of the novel spray apparatus.

Similar reference characters denote corresponding features consistently throughout the attached drawings.

DETAILED DESCRIPTION OF THE PREFERRED EMBODIMENTS

Figure 1:
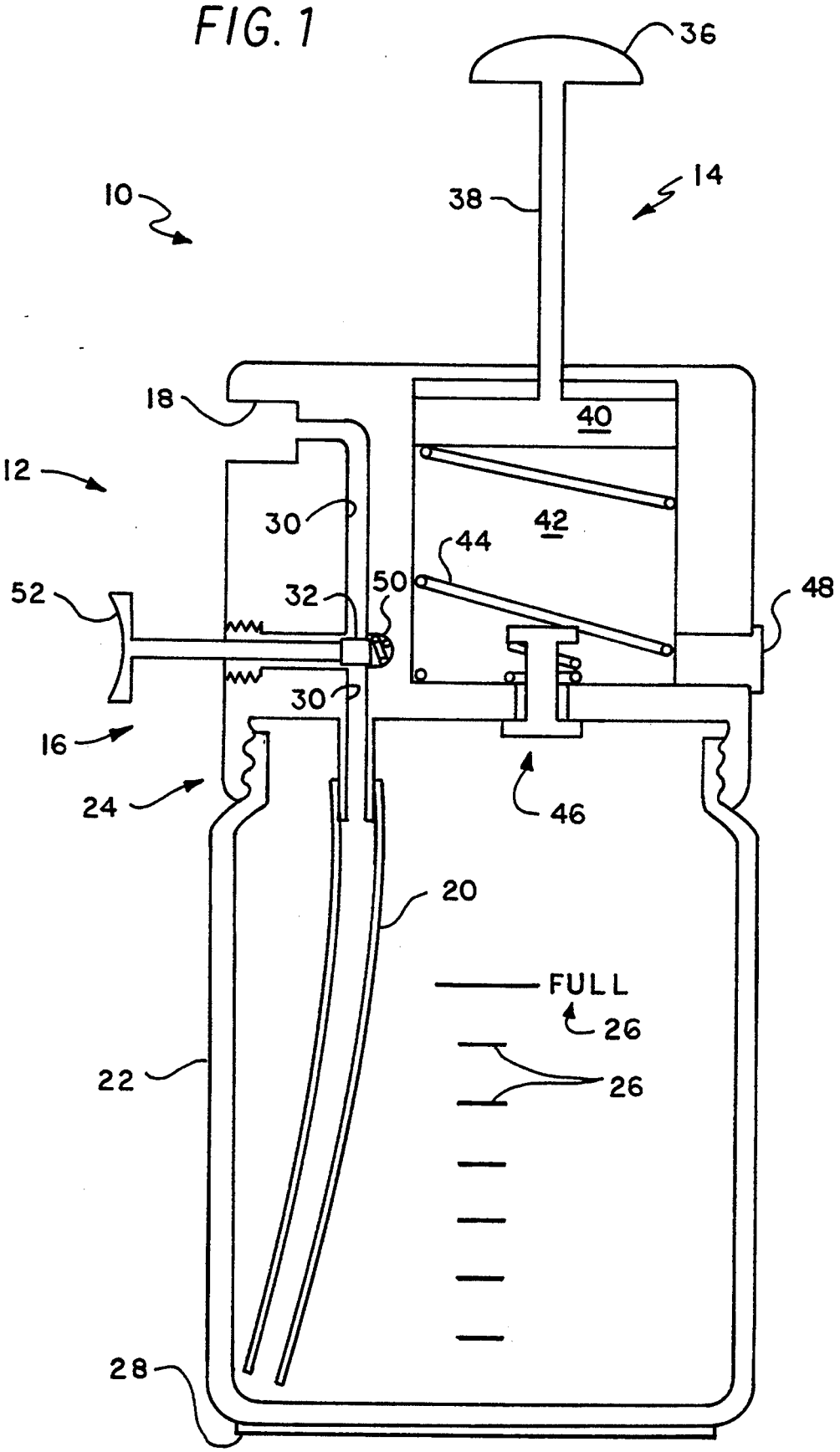
FIG. 1 is a side elevational, cross sectional, diagrammatic view of the novel spray apparatus.

Turning first to FIG. 1, the hygienic spray apparatus of the present invention includes a spray bottle 10 which dispenses a stream of liquid on demand. A cap 12 houses an air pump 14, a manual valve 16, a discharge port 18, and a pickup tube 20 which extends to the bottom of storage container 22. Cap 12 attaches to storage container 22 by friction, and preferably by mutual threading 24.

Storage container 22 is preferably made from a transparent or translucent material, and bears indicia 26 for measuring and for indicating a maximum preferred liquid filling level. A resilient member 28 is provided to cushion the bottom of storage container 22 and to improve frictional grip thereof on a supporting environmental surface (shown hereinafter).

Air pump 14 is manually operated, and compresses air in that portion of storage container 22 not occupied by liquid. Pressure remains until manual valve 16 is operated. Pressurized liquid is then constrained to flow up through pickup tube 20, through a conduit 30 formed in cap 12, past valve plunger 32, then exiting through port 18, which is open to the atmosphere.

Air pump 14 includes a handle 36 and stem 38 forcing a plunger 40 downwardly in a pumping chamber 42 against a spring 44. Air exits pumping chamber 42 through a spring biased, one way check valve 46, and enters storage chamber 22. When spring 44 pushes plunger 40 upwardly to its original position, air is admitted to pumping chamber 42 through a second one way check valve 48.

Manual valve plunger 32 is urged by a spring 50 into a position leaving conduit 30 obstructed. When button 52 is pushed, plunger 32 opens conduit 30, and liquid is free to flow to port 18.

Figures 2, 3:
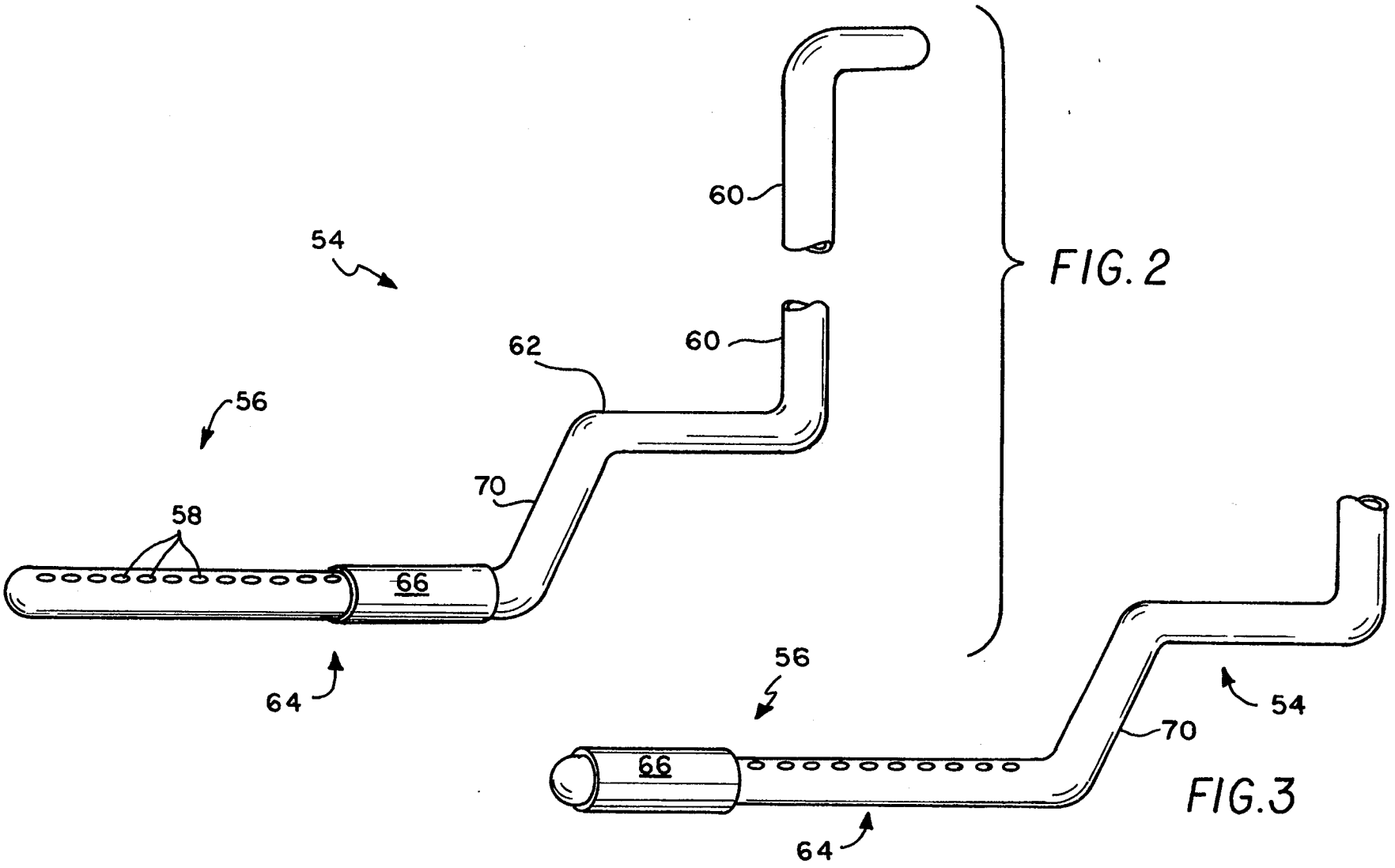
FIGS. 2 and 3 are perspective detail views of a discharge tube, with a sliding sleeve shown in alternative positions on the tube.

Liquid then flows out of cap 12 into a rigid discharge tube 54, seen in FIG. 2. Discharge tube 54 is insertable into port 18, and retained therein by friction. Liquid is ultimately discharged from a nozzle 56 having a plurality of upwardly oriented discharge holes 58.

In order to serve as a portable bidet, the novel apparatus is preferably configured to cooperate with a toilet. With reference to FIGS. 6 and 7, spray bottle 10 is placed on a toilet bowl wall upper surface S or on a portion of a toilet seat S. Discharge tube 54 is formed to have a first section 60 arranged vertically downwardly, and a second section 62 projecting horizontally, radially away from storage container 22. Second section 62 is thus substantially even with the bottom of storage container 22.

A third section 64 is disposed at a level lower than that of second section 62, preferably below the level of the top surface of toilet bowl wall S, and continues to project away from storage container 22. In this manner, discharge tube 54 clears toilet bowl wall or toilet seat S, while still reaching sufficiently far from spray bottle 10 such that spray from nozzle 56 will reach those body parts being treated.

In order to provide adjustment to reach of the spray, a sleeve 66 is slidably mounted on nozzle 56. By moving sleeve 66 appropriately, a user selects certain discharge holes 58 to be operative, others being prevented from discharging liquid.

Figure 4:
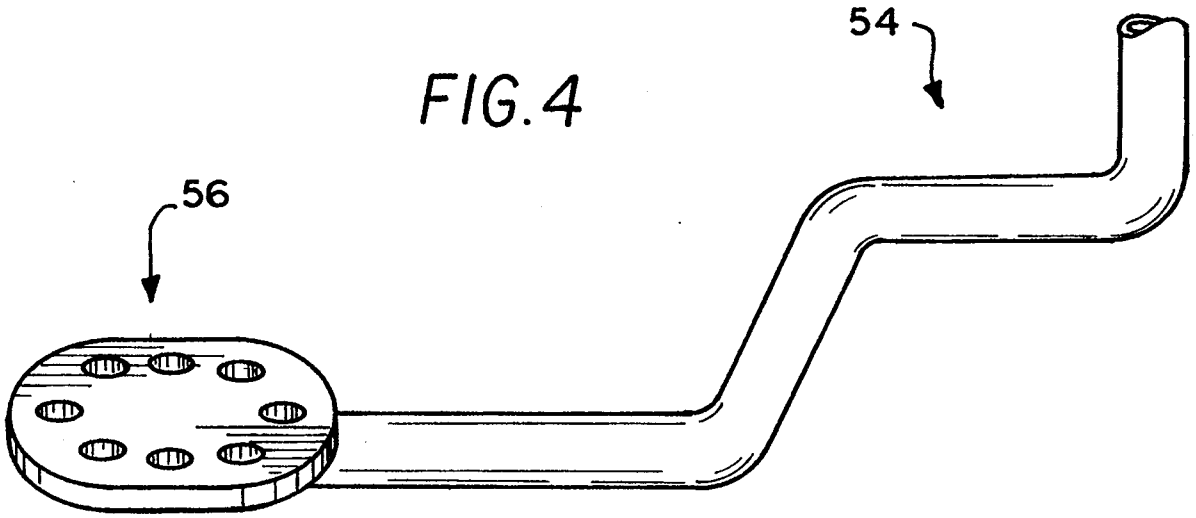
FIG. 4 is a perspective detail view of an alternate embodiment of the discharge tube in accordance with the present invention.

Turning back to FIG. 4, an alternative embodiment discharge tube 54 is shown wherein nozzle 56 is not elongated as in the prior embodiment, and no sleeve 66 is required.

Figure 5:
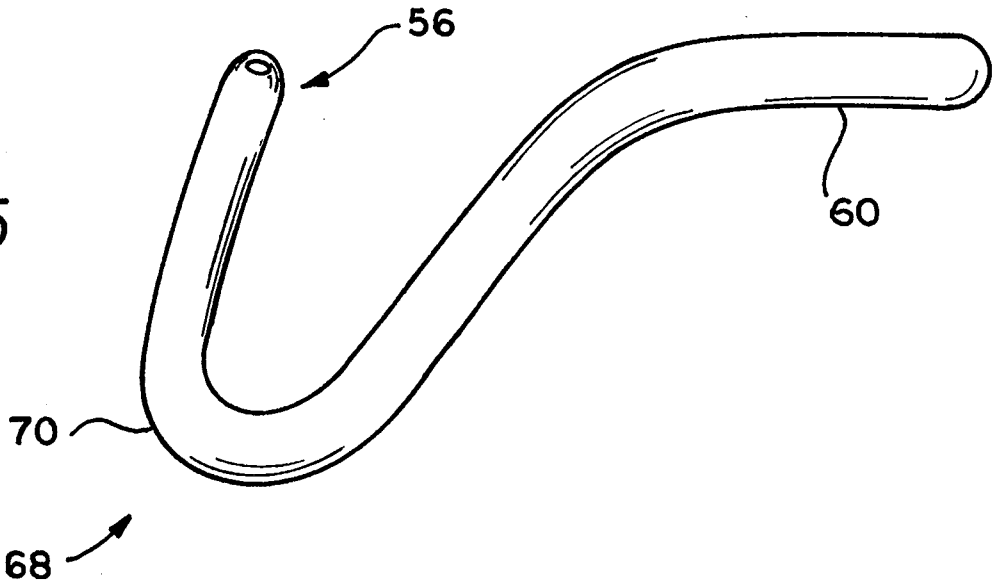
FIG. 5 is a perspective detail view of yet another alternate embodiment of the discharge tube in accordance with the present invention.

To accommodate those users who must insert a nozzle into the body, as for vaginal douching, still another embodiment of a discharge tube is provided, and is illustrated in FIG. 5. Discharge tube 68 includes a flexible section 70. Nozzle 56 is thereby held selectively at variable orientations by a user even while spray bottle 10 is held at a constant orientation, such as resting on toilet bowl wall S (see FIG. 7).

Figure 8:
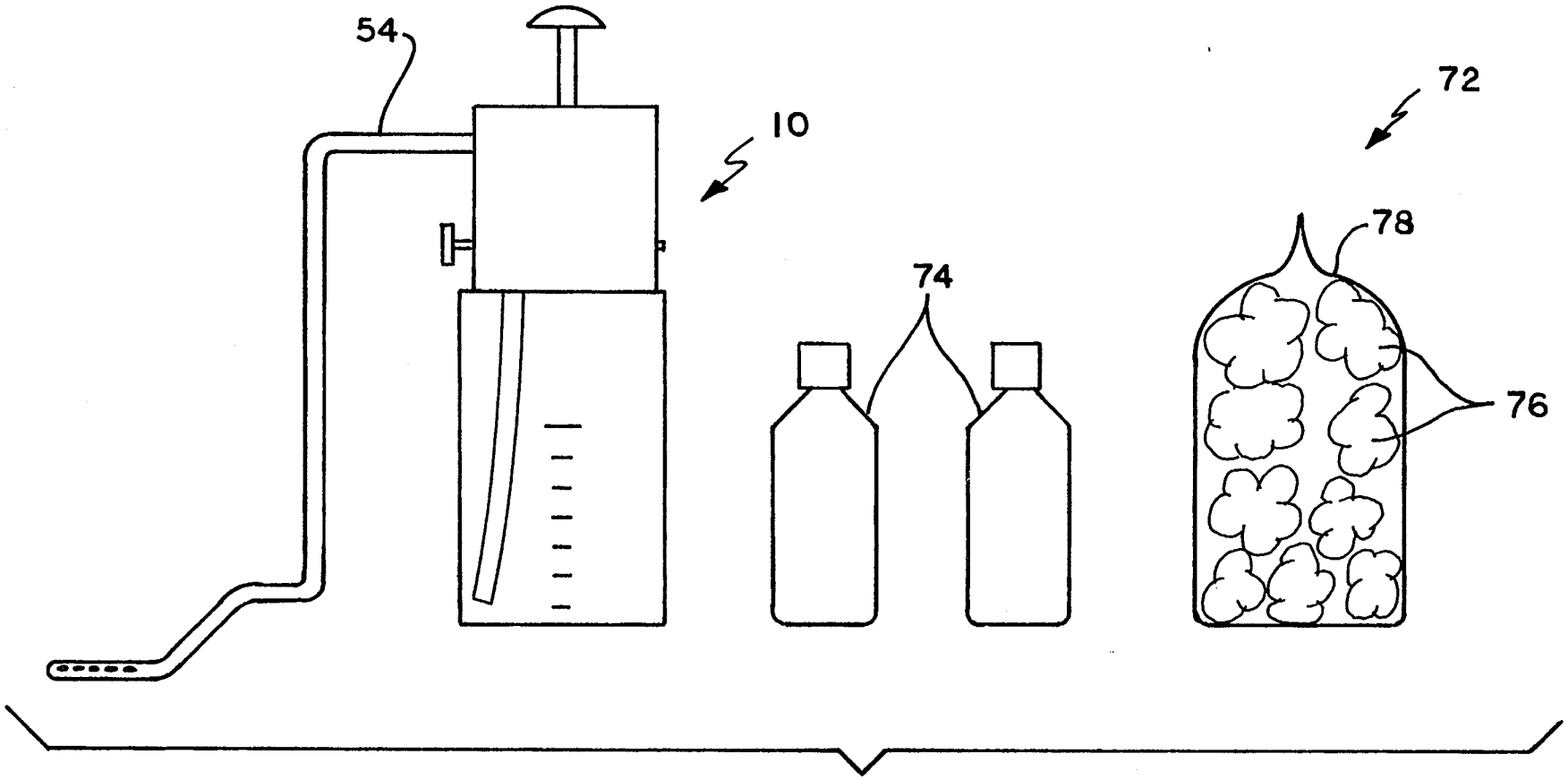
FIG. 8 is a side elevational, diagrammatic view of components of a kit employing the novel spray apparatus.

In order to provide maximal practicality, spray bottle 10 and a selected discharge tube 54 or 68 are combined into a hygienic kit 72. As seen in FIG. 8, kit 72 preferably includes at least one refillable bottle 74 containing a therapeutic liquid (not shown). For drying, cushioning body parts, wiping drippage from spray bottle 10, an absorbent material is provided. A preferred absorbent material comprises cotton swabs 76, contained in an enclosure 78, such as a plastic bag.

Kit 72 thereby provides many sanitary or therapeutic benefits which are frequently forgone when traveling. All necessary materials are included in a compact, light, portable package, and the apparatus is entirely independent of reliance upon plumbing systems, electrical systems, and even battery cells, which are subject to requiring renewal.

It is to be understood that the present invention is not limited to the embodiments described above, but encompasses any and all embodiments within the scope of the following claims.

I claim:

1. A hygienic spray apparatus for storing a liquid, and dispensing a stream thereof on demand, said hygienic spray apparatus comprising:

a storage container for holding liquid to be dispensed;

a cap connecting to said storage container by friction, said cap having a pickup tube projecting downwardly from said cap and extending substantially to the bottom of said storage container, for conducting pressurized liquid into said cap, means defining a conduit conducting liquid through said cap, a manual valve disposed in series within said conduit, for releasing pressurized liquid from said storage container, means defining an externally facing port in said cap, said port communicating between said conduit and the exterior of said cap, a manual air pump for compressing air in said storage container;

a substantially rigid discharge tube insertable into said port, retainable therein by friction, and terminating in a nozzle having means defining upwardly oriented discharge holes, said discharge tube having a first section extending vertically downwardly and a second section having a distal end projecting horizontally radially away from said storage container at a level substantially even with the bottom of said storage container, and wherein said nozzle is below the bottom of said storage container; and a sleeve slidably mounted on said nozzle, wherein certain said discharge holes being covered and prevented from discharging liquid by said sleeve and remaining said discharge holes discharging liquid when said manual valve is operated, whereby a user selects which of said discharge holes are operative, thus enabling liquid to be discharged selectively, nearer and farther from said storage container.

2. The hygienic spray apparatus according to claim 1, wherein a third section connects said nozzle to said second section and extending away from said storage container at a level lower than the level of said second section, whereby said hygienic spray apparatus is supported on top of a toilet bowl wall by said storage container, with said discharge tube located over the toilet bowl, said discharge tube clearing the toilet bowl wall.

3. The hygienic spray apparatus according to claim 1, said storage container being translucent, and having indicia indicating a preferred filling level, whereby a user readily discerns by observation an amount of liquid remaining in said storage container.

4. A hygienic spray kit including:

a hygienic spray apparatus for storing a liquid, and dispensing a stream thereof on demand, said hygienic spray apparatus comprising:

a storage container for holding liquid to be dispensed;

a cap connecting to said storage container by friction, said cap having a manual air pump for compressing air in said storage container, a manual valve for releasing pressurized liquid from said storage container, a pickup tube projecting downwardly from said cap and extending substantially to the bottom of said storage container, means defining an externally open port in said cap, said port communicating between aid pickup tube and the exterior of said cap; and a substantially rigid discharge tube insertable into said port and terminating in a nozzle having means defining upwardly oriented discharge holes, said discharge tube having a first section extending vertically downwardly and a second section projecting horizontally radially away from said storage container at a level below the bottom of said storage container, whereby said nozzle is below the bottom of said storage container;

a sleeve slidably mounted on said discharge tube nozzle; wherein certain said discharge holes being covered and prevented from discharging liquid by said sleeve and remaining said discharge holes discharging liquid when said manual valve is operated, whereby a user selects which of said discharge holes are operative, thus enabling liquid to be discharged, selectively, nearer and farther from said storage container; and at least one refillable bottle containing a therapeutic liquid.

5. The hygienic spray kit according to claim 4, further including a supply of absorbent materials.

6. A hygienic spray apparatus comprising:

a storage container for holding liquid to be dispensed;

a cap connecting to said storage container by friction, said cap having a manual air pump for compressing air in said storage container, a manual valve for releasing pressurized liquid from said storage container, a pickup tube projecting downwardly from said cap and extending substantially to the bottom of said storage container, means defining an externally open port in said cap, said port communicating between said pickup tube and the exterior of said cap; and a substantially rigid discharge tube insertable into said port and terminating in a nozzle having means defining upwardly oriented discharge holes, said discharge tube having a first section extending vertically downwardly and a second section projecting horizontally radially away from said storage container;

a sleeve slidably mounted on said discharge tube nozzle;

wherein the exit of each of said discharge holes reside along a horizontal plane below the horizontal plane containing the bottom of said storage container; and wherein certain said discharge holes being covered and prevented from discharging liquid by said sleeve and remaining said discharge holes discharging liquid when said manual valve is operated, whereby a user selects which of said discharge holes are operative, thus enabling liquid to be discharged, selectively, nearer and farther from said storage container.

7. The hygienic spray apparatus according to claim 6, wherein said discharge tube further includes a third section continuing from said distal end of said second section and extending horizontally radially away from said storage container at a level lower than the level of said second section.

8. The hygienic spray apparatus according to claim 6 wherein said storage container is translucent, and includes indicia indicating a preferred filling level.

* * * * *